United States Patent [19]

Goerlich et al.

[11] Patent Number: 4,991,396

[45] Date of Patent: Feb. 12, 1991

[54] HIGH PERFORMANCE BURNER

[75] Inventors: Dieter Goerlich, Emmering; Rainer Kolodzie, Munich, both of Fed. Rep. of Germany

[73] Assignee: Webasto AG Fahrzeugtechnik, Fed. Rep. of Germany

[21] Appl. No.: 171,117

[22] Filed: Mar. 21, 1988

[30] Foreign Application Priority Data

Mar. 27, 1987 [DE] Fed. Rep. of Germany ..... 3710054

[51] Int. Cl.[5] ..... F01N 3/02

[52] U.S. Cl. ..... 60/303; 60/311; 126/99 A; 126/116 A; 431/5; 431/354

[58] Field of Search ..... 60/286, 303, 311; 431/1, 5, 354; 126/116 A, 99 A

[56] References Cited

U.S. PATENT DOCUMENTS

| | | | |
|---|---|---|---|
| 4,505,106 | 3/1985 | Frankenberg | 60/286 |
| 4,520,624 | 6/1985 | Kiyota | 60/286 |
| 4,574,589 | 3/1986 | Hasegawa | 60/286 |
| 4,615,173 | 10/1986 | Usui | 60/286 |
| 4,651,524 | 3/1987 | Brighton | 60/286 |
| 4,662,172 | 5/1987 | Shinzawa | 60/303 |

*Primary Examiner*—Douglas Hart

*Attorney, Agent, or Firm*—Sixbey, Friedman, Leedom & Ferguson

[57] ABSTRACT

The invention relates to a high performance burner whose performance can be controlled in a stepless manner. To this end, a premixing chamber is upstream of a burner nozzle that extends into a combustion chamber. Fuel is supplied in controllable amounts to the premixing chamber, and a mixture, in the form of an emulsion, is prepared therefrom by means of air supplied from an auxiliary air line. The air-fuel mixture thus prepared is passed to the burner nozzle which diffuses it in the combustion chamber. A high performance burner in accordance with the invention is designed for use as a heating device of high performance, like an independent heating device but, advantageously, can be employed as an exhaust gas afterburner, whereby the high performance burner is disposed in an exhaust gas line of a combustion engine, or a branch line thereto. The afterburning of the exhaust gases being usable for generating of heat by way of an exhaust gas heat exchanger, as well as for the regeneration of soot filters in combustion engines, particularly Diesel combustion engines.

16 Claims, 2 Drawing Sheets

HIGH PERFORMANCE BURNER

BACKGROUND AND SUMMARY OF THE INVENTION

The invention relates to a controllable high performance burner, i.e., a burner which is suitable for the production of high heat outputs of varying degrees. Such a high performance burner has a combustion chamber, with a nozzle extending thereinto, and a mixture preparation device which, among other components, comprises a fuel supply device.

Inasmuch as such high performance burners themsleves produce relatively high temperatures in areas located in front of the combustion chamber, i.e., in the so-called burner headroom which, for instance, may contain the nozzle and the mixture preparation device, any control, and especially stepless control of the performance of such burners, presents difficulties. These difficulties result because such relatively high temperatures tend to affect the temperature-sensitive burner components located therein, thereby jeopardizing a reliably safe operation.

It is a primary objective of the present invention to create a high performance burner which overcomes the above-mentioned drawbacks while enabling its performance to be reliably controlled in a stepless manner. It is a further object to produce such a burner which can be safely operated in a manner which is particularly independent of the temperature level.

In accordance with preferred embodiments of the invention, a high performance burner having a nozzle extending into a combustion chamber, and having a fuel supply device comprising a mixture treatment device, is provided with a mixing chamber for preliminary mixing of fuel and air that is situated upsteam of the burner nozzle. In such a high performance burner, the treatment of the fuel and air (in the form of an emulsion) is facilitated by the premixing chamber, in which the fuel quantity can be varied and can be regulated in an uncomplicated manner to achieve control of the burner performance in a way which, preferably, permits stepless control. The upstream premixing chamber can be located at such an area where it is unaffected by either the temperature in the combustion chamber and/or by other hot gas streams which may occur, e.g., in a process of exhaust gas afterburning. Likewise, the temperature-sensitive burner components are arranged in areas which remain cool to ensure a safe operation.

Advantageously, the premixing in the high performance burner of the invention occurs in the premixing chamber by utilizing auxiliary air which is passed to the premixing chamber from the outside.

Preferably, the fuel quantity which is introduced into the premixing chamber is regulated. To this end, a timed (controlled) solenoid valve, for instance, can be arranged between a fuel pump and the inlet into the premixing chamber. Timing of the solenoid valve permits a reliable control of the fuel quantity entering into the premixing chamber.

The nozzle extending into the combustion chamber diffuses the pretreated fuel-air mixture arriving from the premixing chamber at the inlet side of the combustion chamber of the burner. The mixture is then ignited by a conventional iginition device.

In accordance with another, feature of the invention, the premixing chamber, including the auxiliary air lines and the fuel feed lines, is arranged externally at the burner, in order to perform the premixing occuring in the premixing chamber, independent of the temperatures in the combustion chamber, and/or independent of a possible hot exhaust gas stream.

The auxiliary air delivery device and the fuel supply device, with a fuel pump, and possibly with a fuel regulating device, like a solenoid valve, may constitute a single component with the premixing chamber. Such a component is arranged at an appropriate location, separate from the burner, and by suitable means is in communication with the nozzle extending into the combustion chamber.

The inventive design of the high performance burner not only makes it practical for generating heat by means of a heating device, but the device can also, advantageously, be put into service in connection with the afterburning of exhaust gases. Such afterburning of exhaust gases not only includes regeneration of the soot filter of a combustion engine, particularly that of a Diesel combustion engine, but also comprises the afterburning of exhaust gases in connection with an exhaust gas heat exchanger used for heating purposes. In the latter case, the burner serves to generate heat during those phases when the heat contents of the motor's exhaust gases are insufficient for delivering heat. The auxiliary air introduced in to the premixing chamber not only effects mixing of the varying fuel quantities passed to the premixing chamber, but, moreover, serves to blow out and clean the fuel line and the nozzle during pauses in combustion, and thus, aids in preventing coking of the fuel and, simultaneously, serves to cool the nozzle exposed to the hot exhaust gas stream of the combustion engine.

These and further objects, features and advantages of the present invention will become more obvious from the following description when taking in connection with the accompanying drawings which show, for purposes of illustration only, several embodiments in accordance with the present invention.

DETAIL DESCRIPTION OF THE PREFERRED EMBODIMENTS

Figure 1:
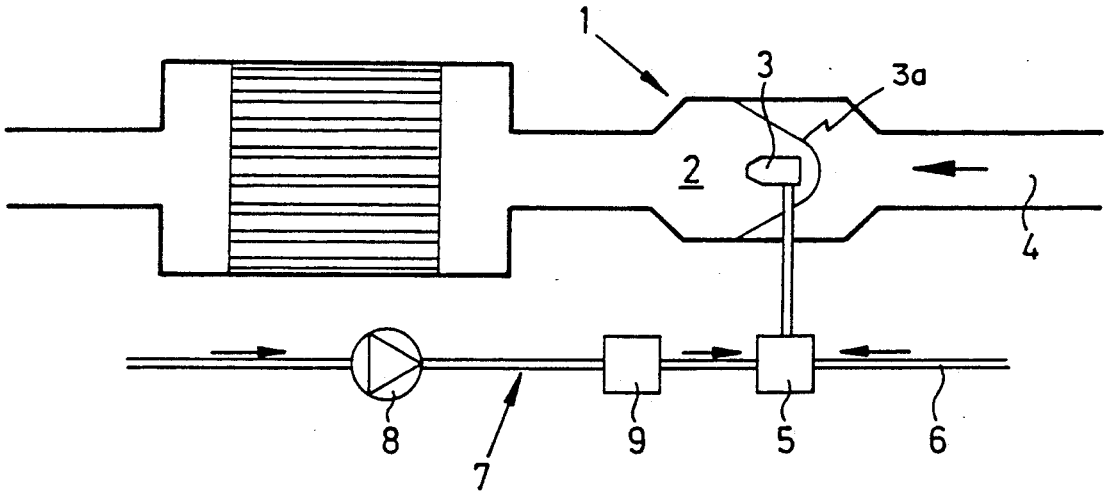
FIG. 1 is a schematic view of a high performance burner in an exhaust gas line of a combustion engine, depicting a soot filter undergoing regeneration, as an example of exhaust gas afterburning.

In the following drawings description, components are designated with identical reference numerals, with prime (') designations used to distinguish between burner implementation embodiments.

In FIG. 1, a high performance burner (which, for reasons of clarity, is not decipted in detail) is designated with reference numeral 1. For comprehension of the invention, it sufficies to note that high performance burner 1 comprises a combustion chamber 2 having a nozzle 3 projecting thereinto, whose orifice points into combustion chamber 2, and which is, per se, of conventional design. As can be seen, burner 1 is disposed in exhaust gas line 4 of a combustion engine (not shown). In order to prevent operation of nozzle 3 from being disrupted by the exhaust gases flowing past the nozzle 3 from exhaust gas line 4, nozzle 3 is disposed within a parabolic screening or shielding means 3*a* which will deflect the exhaust gases outwardly away from nozzle 3. In this connection, while the parabolic shield 3*a* is preferred, other similarly functioning baffle structures or the like may be used so long as they divert, but do not obstruct, the flow of exhaust gases past nozzle 3.

A premixing chamber 5 is located upstream of nozzle 3 and is supplied with auxiliary air, via air line 6, on the one hand, and with fuel, via fuel supply device 7, on the other hand. As schematically depicted in FIG. 1, the fuel supply device 7 comprises a fuel pump 8 and a fuel regulating device 9 that is disposed between the outlet of fuel pump 8 and the inlet into premixing chamber 5. The fuel regulating device may, for instance, consist of a solenoid valve which is cyclically controlled for adjusting the fuel supplied to the premixing chamber 5.

Use of premixing chamber 5 is an important aspect of the invention since, in a novel way, it enables burner 2 to operate by combusting the fuel-air mixture prepared by premixing chamber 5 without any means being required to vaporize the fuel directly within the combustion chamber of the burner. Furthermore, such a fuel-air mixture is especially easy to ignite without any substantial addition of air, or of exhaust gas, which is hindered from mixing with the premixed air and fuel by the screening or shielding means 3*a*, mentioned above. On the other hand, the specific design of the premixing chamber is not critical so that any arrangement which will effectively cause the air from line 6 to mix with the fuel, such as fuel oil, from fuel device 7 to create an air-fuel emulsion (including known aeration techniques) may be used. For preparing the air-fuel emulsion, for instance, air is supplied tangentially by producing a twisting motion, whereas the fuel is supplied in an axial direction.

Figure 2:
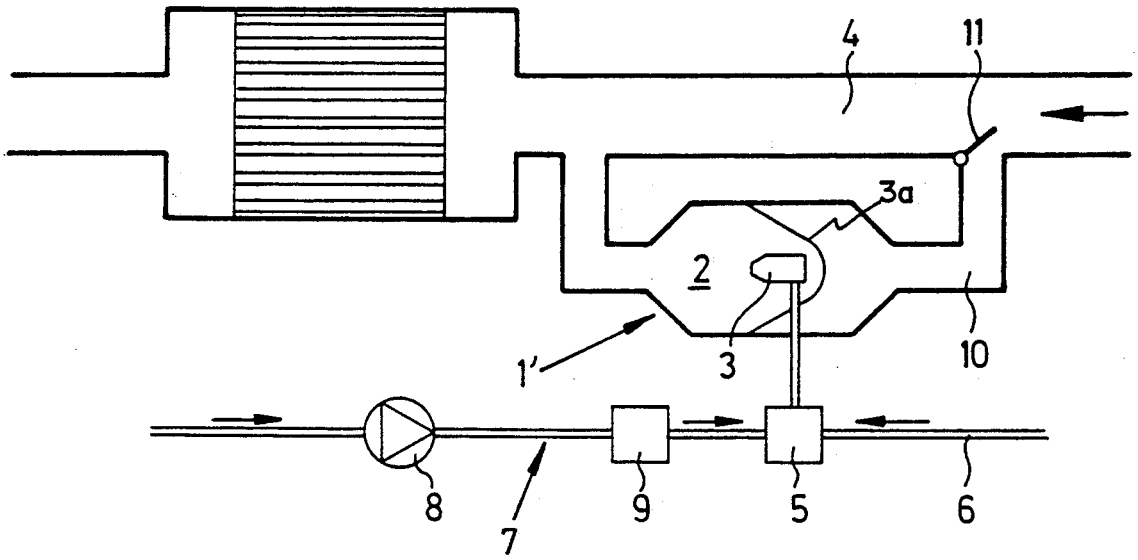
FIG. 2 is a schematic view of a variation of the design according to FIG. 1, where the high performance burner is connected in parallel to the exhaust gas line of the combustion engine leading to the soot filter.

The embodiment depicted in FIG. 2 differs from that depicted in FIG. 1 only in that the high performance burner 1′ is not directly arranged in exhaust gas line 4, but is, instead, arranged in a branch line 10, which is parallel thereto, and which can be opened and closed by control flap 11, depicted schematically in the drawing.

Figure 3:
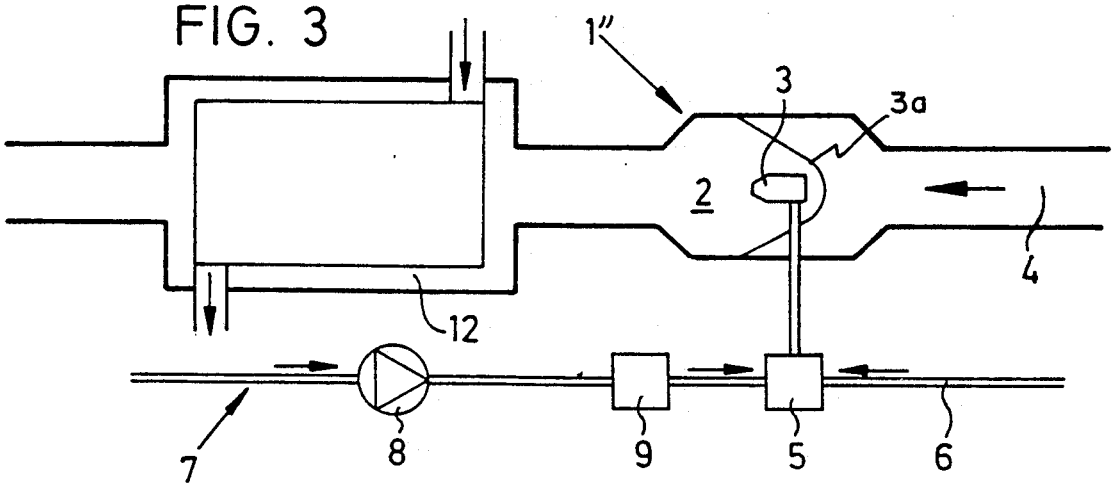
FIG. 3 is a schematic view of a variation of the invention, in which an exhaust gas heat exchanger is arranged in the exhaust gas line, upstream of which there is a high performance burner.

FIG. 3 illustrates an alternate example of an exhaust gas afterburning arrangement in which an exhaust heat exchanger 12 is disposed in exhaust gas line 4, adjacent to the high performance burner 1″, instead of a soot filter. This exhaust gas heat exchanger facilitates utilization of heat contained in the exhaust gases for heating purposes, for instance. In the event that exhaust gas heat exchanger 12 is unable to supply adequate heat because the temperature of the exhaust gases in exhaust gas line 4, supplied by the combustion engine (not depicted), is no longer sufficiently high, the exhaust gases are heated with the aid of high performance burner 1″ before they enter into the exhaust heat exchanger. Consequently, even when the exhaust gas delivered by the combustion engine contains an inadequate amount of heat, gas heat exchanger 12 can still deliver heat for heating purposes, for example. Further details shown in FIG. 3 conform to those previously outlined in context with FIG. 1.

It is to be understood that, similar to an arrangement shown in FIG. 2, the high performance burner 1″, shown in the example given in FIG. 3, may also be arranged in a branch line 10, parallel to exhaust gas line 4.

Figure 4:
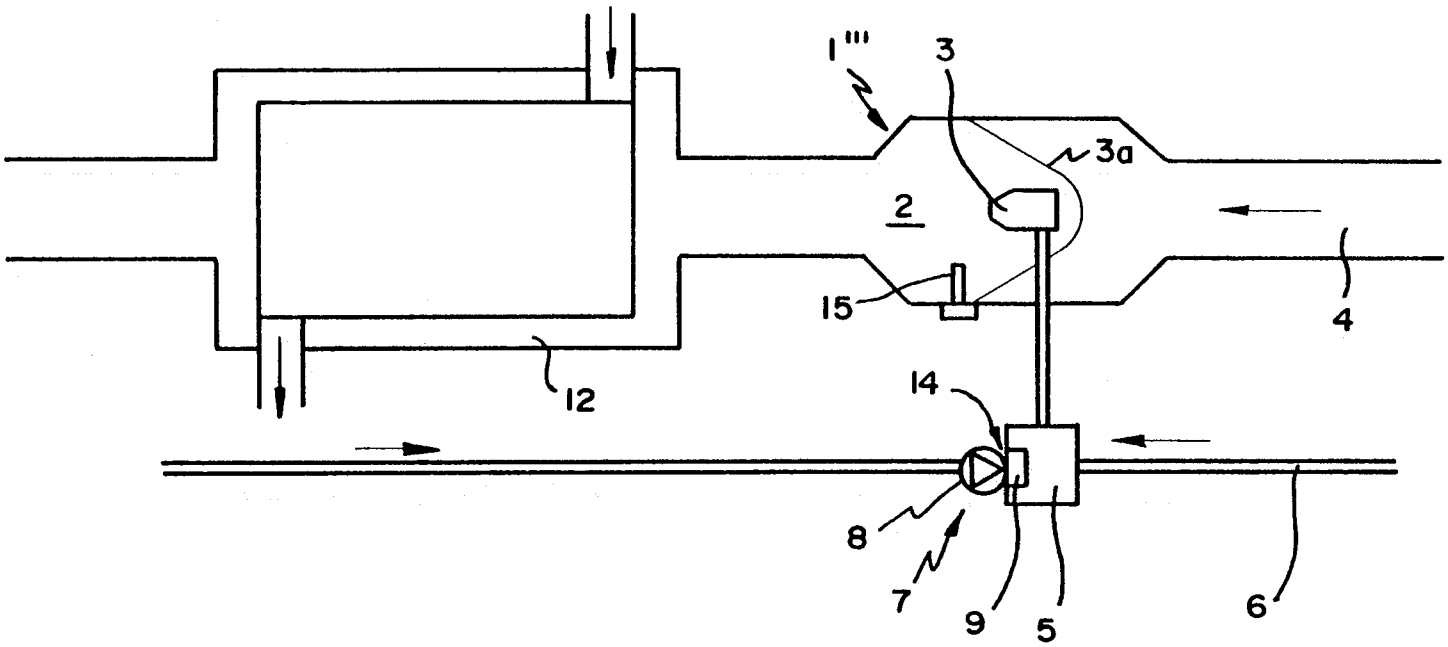
FIG. 4 is a schematic view, similar to FIG. 3, of a modified embodiment.

It is further to be understood that the invention is not limited to the examples depicted, but that the high performance burner of the invention may also be utilized for a heating device, like an auxiliary vehicle heating device, in which case the device is not arranged in the exhaust gas system of the vehicle, but is located in another appropriate area of the vehicle. Also, as shown in FIG. 4, the fuel pump 8, fuel supply device 7 and the device supplying auxiliary air 6, together with the premixing chamber 5, may form a single component 14, which should appropriately be disposed at a relatively cool location, i.e., outside the reach of the hot exhaust gases, for instance.

The following is a description of the operating method of high performance burner 1, 1′, 1″, 1‴.

As shown, premixing chamber 5 is upstream of burner 1, 1′, 1″, 1‴ and, for example, may be arranged on the outside thereof at a suitable location. The fuel supplied to the premixing chamber by fuel pump 8, via fuel control device 9, preferably is steplessly controllable (i.e., infinitely variable). The mixture prepared into an emulsion in the premixing chamber is passed to nozzle 3 and is atomized in combustion chamber 2. In this regard, the only measure that has to be taken in order to avoid any separation of the fuel and air of the mixture in the line leading from premixing chamber 5 to nozzle 3 is to insure that the line is as short as possible. After being atomized into the combustion chamber 2, by nozzle 3, the mixture is ignited, preferably in a zone shielded by shielding means 3*a*, via a conventional ignition device 15 which, for reasons of drawing simplicity, is only shown in FIG. 4, although always present.

The auxiliary air cleans both the lines and the nozzle during combustion pauses in order to avoid coking of the fuel which would cause corroding of the lines. Also, nozzle 3 is disposed in the hot exhaust gas stream of the combustion engine to ensure a reliable restart of burners 1, 1′, 1″, 1‴.

Although not depicted in detail, the assembly comprising premixing chamber 5 may contain additional components of the burner which are temperature sensitive and tend to malfunction at high temperatures. Consequently, the high performance burner 1, 1′, 1″, 1‴ in a ccordance with the invention, is operationally reliable and, particularly, permits a stepless control of the output supplied by high performance burner 1, 1′, 1″, 1‴.

While we have shown and described various embodiments in accordance with the present invention, it is understood that the same is not limited thereto, but is susceptible of numerous changes and modification as known to those skilled in the art, and we, therefore, do not wish to be limited to the details shown and described herein, but intend to cover all such changes and modifications as are encompassed by the scope of the appended claims.

What is claimed:

1. High performance burner arrangement having a burner nozzle extending into a combustion chamber and an air-fuel mixture preparation device containing a fuel supply unit, wherein said mixture preparation device comprises a premixing chamber means, connected to said fuel supply unit and to a source of air, for producing a mixture of fuel and air, said premixing chamber means being located upstream of said burner nozzle, externally of the combustion chamber and being connected to said burner nozzle for supplying the mixture of air and fuel to said burner nozzle as an air-fuel emulsion, said premixing chamber and burner nozzle together forming means for atomizing the mixture into the combustion chamber in a manner enabling combustion of the mixture within the combustion chamber without requiring any means to vaporize the fuel directly within the combustion chamber; wherein said burner nozzle is located in an exhaust gas line, and wherein shielding means is provided for preventing exhaust gases in said exhaust gas line from flowing directly to said burner nozzle and mixing with the mixture of fuel and air being atomized into the combustion chamber.

2. High performance burner arrangement according to claim 1, wherein said source of air is in auxiliary air line which is arranged to act upon fuel from said fuel supply device when the auxiliary air enters into said premixing chamber means.

3. High performance burner arrangement according to claim 2, wherein said fuel supply unit includes means for regulating the fuel quantity introduced into the premixing chamber means.

4. High performance burner arrangement according to claim 3, wherein said means for regulating the fuel quantity comprises a timed controlled solenoid valve.

5. High perfomance burner arrangement according to claim 1, wherein said burner nozzle is situated in an exhaust gas line as a means for producing exhaust gas afterburning.

6. High performance burner arrangement according to claim 3, wherein said premixing chamber means is arranged externally of said combustion chamber.

7. High performance burner arrangement according to claim 6, wherein said burner nozzle is situated in an exhaust gas line as a means for producing exhaust gas afterburning.

8. High performance burner arrangement according to claim 4, wherein said premixing chamber means is arranged externally of said combustion chamber.

9. High performance burner arrangement according to claim 8, wherein said means for regulating the fuel quantity comprises a timed controlled solenoid valve.

10. High performance burner arrangement according to claim 9, wherein said auxiliary air line is arranged in conjunction with the premixing chamber means to continuously maintain a flow of air to said burner nozzle during pauses in combustion occuring from termination of the fuel quanitity supply produced by said time controlled solenoid valve.

11. High performance burner arrangement according to claim 10, wherein said burner is located upstream of a soot filter in said exhaust gas line for producing regenaration of the soot filter by said exhaust afterburning.

12. High performance burner arrangement according to claim 7, wherein said burner is located upstream of a soot filter in said exhaust gas line for producing regeneration of the soot filter by said exhaust afterburning.

13. High performance burner arrangement according to claim 5, wherein said burner is located upstream of a soot filter in said exhaust gas line for producing regeneration of the soot filter by said exhaust afterburning.

14. High performance burner arrangement according to claim 10, wherein said burner is located in said exhaust gas line upstream of an exhaust gas heat exchanger.

15. High performance burner arrangement according to claim 7, wherein said burner is located in said exhaust gas line upstream of an exhaust gas heat exchanger.

16. High performance burner arrangement according to claim 5, wherein said burner is located in said exhaust gas line upstream of an exhaust gas heat exchanger.

* * * * *